US010752437B2

(12) United States Patent
Kemp

(10) Patent No.: US 10,752,437 B2
(45) Date of Patent: Aug. 25, 2020

(54) ROLL-OFF BIN WITH CLAMSHELL LID

(71) Applicant: FUSION WEST MANUFACTURING SOLUTIONS INC., Saskatoon (CA)

(72) Inventor: Glen Kemp, North Battleford (CA)

(73) Assignee: Fusion West Manufacturing Solutions Inc., Saskatoon (CA)

( * ) Notice: Subject to any disclaimer, the term of this patent is extended or adjusted under 35 U.S.C. 154(b) by 0 days.

(21) Appl. No.: 16/250,999

(22) Filed: Jan. 17, 2019

(65) Prior Publication Data

US 2019/0218030 A1 Jul. 18, 2019

Related U.S. Application Data

(60) Provisional application No. 62/618,254, filed on Jan. 17, 2018.

(51) Int. Cl.

| | |
|---|---|
| ***B65D 90/62*** | (2006.01) |
| ***B65D 90/66*** | (2006.01) |
| ***B65F 1/16*** | (2006.01) |
| ***B65D 88/12*** | (2006.01) |
| *B65D 88/10* | (2006.01) |

(52) U.S. Cl.

CPC ..... *B65F 1/1623* (2013.01); *B65D 88/126* (2013.01)

(58) Field of Classification Search

CPC ..... B65F 1/1623; B65D 88/126

USPC ..... 220/1.5, 213, 252, 262, 264, 345.5, 348, 220/908

See application file for complete search history.

(56) References Cited

U.S. PATENT DOCUMENTS

| | | | | | |
|---|---|---|---|---|---|
| 4,603,787 | A * | 8/1986 | Essary | B65D 88/126 | 220/1.5 |
| 4,653,662 | A * | 3/1987 | Wise | B65F 1/16 | 220/262 |
| 4,934,562 | A * | 6/1990 | Early | B65D 90/008 | 220/1.5 |
| 5,158,198 | A * | 10/1992 | Melideo | B65D 88/126 | 220/263 |
| 5,599,050 | A * | 2/1997 | Tinsley | B65F 1/1615 | 220/908 |
| 5,897,014 | A * | 4/1999 | English | B65F 1/1623 | 220/263 |
| 6,837,393 | B1 * | 1/2005 | Kuo | B65F 1/1607 | 220/263 |

(Continued)

*Primary Examiner* — J. Gregory Pickett
*Assistant Examiner* — Niki M Eloshway
(74) *Attorney, Agent, or Firm* — Donald V. Tomkins

(57) ABSTRACT

A lid assembly for a rectilinear bin includes two lid panels independently movably mounted to the bin such that when the lid assembly is in a fully-closed position, inner longitudinal edges of the panels abut each other so as to give the closed lid assembly an arched configuration. In the open position, each lid panel lies vertically along the exterior of a corresponding bin sidewall. Each lid panel is movable along tracks provided in the bin structure longitudinally outboard of the lid assembly by means of track wheels provided at each end of the panel's inner longitudinal edge. Each lid panel is movable between its open and closed positions by means of actuating arms each pivotably mounted at one end to the panel's outer longitudinal edge, and rigidly mounted at the other end to a rotatable horizontal lid actuation shaft mounted on the exterior of a corresponding bin sidewall.

14 Claims, 12 Drawing Sheets

(56) References Cited

U.S. PATENT DOCUMENTS

| | | | | |
|---|---|---|---|---|
| 2002/0008403 | A1* | 1/2002 | Ser | B65D 88/126<br>296/100.08 |
| 2002/0017529 | A1* | 2/2002 | Kruzick | B65F 1/1615<br>220/813 |
| 2002/0088812 | A1* | 7/2002 | Petzitillo, Jr. | B65D 88/126<br>220/812 |
| 2018/0086186 | A1* | 3/2018 | Haag | B60J 7/028 |

* cited by examiner

ROLL-OFF BIN WITH CLAMSHELL LID

FIELD

The present disclosure relates in general to waste containers, variously known as roll-off bins, "dumpsters", and other names, and relates in particular to lids and lid-opening mechanisms for such containers.

BACKGROUND

Roll-off bins are widely used for a variety of purposes, such as (to name only a few) for collecting waste and debris from construction and demolition sites, general industrial waste, and hazardous waste. After being loaded with such waste materials, the bins are transported to appropriate disposal sites where they are emptied.

Roll-off bins are so-named because they typically have wheels at one end so that they can be loaded onto tilting flatbed trailers (or "roll-off trucks"), or onto non-tilting flatbed trailers using suitable ramps, then transported to an industrial site (for example) where they are rolled off into position to be filled with waste materials. Roll-off bins are typically of rectangular configuration, with a generally flat rectangular floor structure and a pair of longitudinal sidewalls extending between a pair of transverse endwalls, so as to define an open-top waste containment chamber. Especially on larger roll-off bins, one of the endwalls (typically at the wheeled end of the bin) may be hinged, either vertically or horizontally, to facilitate rapid emptying—for example, by opening the hinged endwall while the loaded bin is still securely mounted on a roll-off truck which then tilts the bin so that its contents slide out the open endwall by gravity.

Roll-off bins can vary greatly in size. They commonly have a nominal width of 8 feet, corresponding to the typical maximum permissible width for highway vehicles without requiring special permits. Common volumetric capacities for roll-off bins range from 10 to 40 cubic yards, depending on bin length and bin wall height.

Roll-off bins typically require a lid for one or more reasons, such as for protection of bin contents from the weather, for prevention of loss of bin contents during transport, for general security reasons, and for the safety of workers and the public. Numerous types of roll-off bin lids are known in the prior art. The simplest types are flat lids hinged along the top of one of the bin sidewalls, without the provision of any mechanism for opening and closing the lid. For light-duty waste bins (such as the smaller plastic refuse bins commonly seen in residential complexes for collection of household waste), such simple hinged lids may be quite satisfactory, since they typically are relatively light in weight, and thus can be easily opened by a single person, and can close by gravity with minimal risk of inadvertent personal injury. However, larger waste bins are generally made from steel, for both structural strength and durability. Accordingly, the lids for such bins can be quite heavy, and as a practical matter they will typically require some sort of mechanism to facilitate efficient opening and closing, while providing protection against injury that could be caused by inadvertent and uncontrolled closing of the lid.

For these reasons, it is common for hinged lids for roll-off bins to use a winch apparatus for opening and closing the lid, operated either manually or by an electric motor. Such apparatus typically entails the provision of a gin pole or other auxiliary structure to support associated pulleys and cables. Other apparatus for opening and closing heavy roll-off bin lids may use hydraulic cylinders, which can be arranged to avoid the need for auxiliary structure extending above the bin walls. However, roll-off bins are very often used in circumstances and locations where electric or hydraulic operation of bin lids is not feasible or practical, so for practical reasons it commonly must be possible for roll-off bin lids to be opened and closed manually.

Regardless of the particular type of mechanisms that may be used to open and close them, hinged roll-off bin lids have a significant drawback in that when they are in an open or partially-open position, they will project above the bin walls and thus be exposed to wind forces. Accordingly, the lids, hinge mechanisms, and associated structural elements must be designed to withstand strong wind forces that might otherwise damage these components, necessitating costly repairs and putting the bins out of service. As a result, the lids will be heavier and costlier than they would be if they did not need to be designed for wind forces.

Furthermore, even hinged lids that have associated winch mechanisms or electrical or hydraulic operating systems can present a safety hazard in the case of failure of one or more components of such mechanisms or systems (for example, breakage of a winching cable, or loss of hydraulic pressure). In such scenarios, serious personal injury could result from the sudden uncontrolled closing of a heavy hinged lid.

These disadvantages and risks can be avoided by using rolling lids, many examples of which can be seen in prior art bins. In common types of rolling lids, the lid has wheels that travel in or on horizontal tracks, such that the lid can be displaced laterally away from one bin sidewall toward the other sidewall by means of an associated operating mechanism (such as a rack-and-pinion gear arrangement) operated manually by means of a crank. The rolling lid has a longitudinal pivot axis at approximately its mid-width (i.e., parallel to the sidewalls), and this pivot axis moves laterally with the lid. The lid will remain essentially horizontal until it has been laterally displaced far enough that the pivot axis lies outboard of one of the sidewalls. At that point, the lid can be pivoted 90 degrees such that half of its width is disposed against the exterior of that sidewall, with the other half of its width projecting above the top of the sidewall.

One beneficial feature of the rolling lid described above is that it opens the top of the bin to its full width. Another beneficial feature is that it largely eliminates the above-noted safety risks associated with hinged lids. However, one significant practical drawback of this lid design is that its overall width must be greater than the width of the bin itself, because the tracks for the lid must extend a certain distance beyond at least one of the bin sidewalls to facilitate rotation of the lid into a vertical plane. Accordingly, the maximum allowable width of the bin itself, and its volumetric capacity (for a given bin length and height), will be less than for other bin designs in order to stay within maximum vehicle load widths under many highway transportation regulations (i.e., typically 8 feet). Another drawback of the rolling lid is that half of its surface area still projects above the bin walls and thus will be exposed to wind loads.

For the foregoing reasons and others, there is a need for improved waste container lid designs that will:

- eliminate or significantly reduce potential safety hazards associated with conventional hinged bin lids;
- eliminate or minimize bin lid exposure to wind forces when the lid is in an open position; and
- facilitate maximization of usable bin width while complying with regulated vehicle load width restrictions.

BRIEF SUMMARY

In a first aspect, the present disclosure teaches a "clamshell" lid assembly for a generally rectilinear (e.g., square or rectangular) roll-off bin, where the lid assembly includes two independently-operable panels having inner longitudinal edges that close against each other when the lid assembly is in the fully-closed position, and where each lid panel, when in the open position, lies alongside the exterior face of a corresponding bin sidewall. More specifically, the present disclosure teaches an open-top bin having:

a floor, a first endwall, a second endwall, and a pair of opposing longitudinal sidewalls, wherein said endwalls and sidewalls extend upward from the floor, and each sidewall extends between the first and second endwalls;

a first track box structure extending vertically above and horizontally between the sidewalls, and extending horizontally from the first endwall to a first inner track box wall, wherein said first inner track box wall carrying a first bin lid track;

a second track box structure extending vertically above and horizontally between the sidewalls, and extending horizontally from the second endwall to a second inner track box wall, so as to define a bin roof opening bounded by the sidewalls and the first and second inner track box walls, and wherein said second inner track box wall carries a second bin lid track corresponding to the first bin lid track;

a bin lid assembly comprising a pair of bin lid panels configured to cover, in combination, substantially the full area of the bin roof opening, wherein at least one of the bin lid panels is a movable bin lid panel having an inner longitudinal edge and an outer longitudinal edge; a longitudinal beam extending below and along the length of said inner longitudinal edge; and a track wheel at each end of the longitudinal beam, said track wheel being engageable with either the first or second bin lid track; and bin lid actuation means associated with each movable bin lid panel;

in which the bin lid tracks define selected paths of travel for the inner longitudinal edge of the movable bin lid panels, such that the bin lid actuation means can be operated to move the movable bin lid panel between:

a closed position in which the outer longitudinal edge of the movable bin lid panel is proximal to the top of one of the sidewalls, with the bin lid panel's track wheels being disposed within their corresponding bin lid tracks at a medial position between the sidewalls; and an open position in which the movable bin lid panel is positioned alongside and external to the associated sidewall, with the movable bin lid panel's track wheels being disposed within their corresponding bin lid tracks at a lateral position proximal to the lateral position of the associated sidewall.

When a given one of the lid panels is in the closed position, its inner longitudinal edges preferably will lie mid-way between the bin's longitudinal sidewalls, but at a selected height above the top of the sidewalls, while the panel's outer longitudinal edge closes against the upper edge of the corresponding sidewall. Accordingly, when both lid panels are closed, the lid assembly will have a generally arched or vaulted configuration.

Each end of each inner longitudinal lid panel edge is movable within or along a lid track provided in a corresponding track housing structure mounted on the bin structure, longitudinally outboard of the lid assembly. The lid tracks are configured to define a selected path of travel for the inner lid panel edges as the lid panels move between their closed and open positions. In one embodiment, the lid tracks are provided in the form of slots formed in vertically-oriented plates incorporated into the track housing structure, with a flanged wheel provided at each end of each inner longitudinal lid panel edge to run within the corresponding lid track.

A horizontal lid actuation shaft is mounted at a selected height on the exterior of each bin sidewall, with the shaft being supported by and rotatable in suitable bearings mounted to the sidewall at selected intervals along the length of the shaft. At least two pivot arms are provided in association with each lid actuation shaft, with one end of each pivot arm being securely mounted to each shaft (such as by welding), and with the other end being pivotably mounted to the outer longitudinal edge of the corresponding lid panel. Accordingly, when a given lid panel is in the closed position, the corresponding pivot arms will extend vertically upward from the lid actuation shaft. Rotation of the lid actuation shaft in a first direction will cause the pivot arms to pivot outward and away from the bin sidewall, thus pulling the outer longitudinal edge of the lid panel outward as well, with the wheels at the end of the lid panel's inner longitudinal edge following their respective lid tracks in the track housing structures.

The lid tracks are configured such that continued rotation of the lid actuation shaft will move the lid panel's inner longitudinal edge past the edge of the corresponding bin sidewall, such that the pivot arms will then extend vertically downward from the actuation shaft, and the lid panel will lie essentially vertically alongside the outer face of the sidewall. Rotation of the actuation shaft in the opposite direction will move the lid panel back toward its closed position. The layout of the lid tracks for a particular bin design may be selected to suit case-specific operational criteria, while ensuring adequate clearance between the lid panels and the sidewalls as the lid panels cycle between the open and closed positions.

The lid actuation shaft may be rotated by any operatively effective means, and embodiments in accordance with the present disclosure are not limited to the use of any particular shaft rotation means. By way of non-limiting example, the lid actuation shaft can be manually rotated by means of a crank-operated gearbox. The two lid actuation shafts may be rotatable independently of each other to enable opening of only one lid panel if desired. Alternatively, the shaft rotation means may be configured to enable both lids to be opened or closed simultaneously.

Operation of the lid actuation shafts can be facilitated by providing counterweighting means to reduce the rotational force that needs to be applied or transmitted to the shaft. By way of non-limiting example, effective counterweighting means may be provided by helical springs deployed between the bin structure and the pivot arms such that the springs will go into tension as the corresponding actuation shafts are rotated to open the bin lid panels. In certain embodiments, the resultant spring forces may reduce the force required to move a lid panel from the open position to the closed position enough that the panel can be readily closed by manually rotating the pivot arms, without need for a gearbox or other auxiliary lid opening and closing mechanisms.

In the ideal case, the total spring forces acting on the lid panel, when it is in the open alongside the bin sidewall, would equal the weight of the panel, such that the only forces that need to be applied to begin the lid panel closing cycle would be those required to overcome friction in the mechanism. However, even if this "perfect balance" is not achieved, the required bin-opening forces will still be comparatively small.

In addition to the benefits that they provide during the lid-closing cycle, the springs also act as a brake on the lid panel during the lid-opening cycle, to prevent the panel from picking up excess speed due to gravity as it rotates into a vertical plane, thus cushioning the downward movement of the panel so that it does not "run away" and slam down into the open position.

In a second aspect, the present disclosure teaches a unitary (i.e., single-section) lid (alternatively referred to herein as an "arch lid") for a rectilinear roll-off bin. More specifically, the present disclosure teaches an open-top bin having:

a floor, a first endwall, a second endwall, and a pair of opposing longitudinal sidewalls, wherein said endwalls and sidewalls extend upward from the floor, and each sidewall extends between the first and second endwalls;

a first track box structure extending vertically above and horizontally between the sidewalls, and extending horizontally from the first endwall to a first inner track box wall, wherein said first inner track box wall carrying a first bin lid track;

a second track box structure extending vertically above and horizontally between the sidewalls, and extending horizontally from the second endwall to a second inner track box wall, so as to define a bin roof opening bounded by the sidewalls and the first and second inner track box walls, and wherein said second inner track box wall carries a second bin lid track corresponding to the first bin lid track;

an arched bin lid configured to cover substantially the full area of the bin roof opening, wherein said arched bin lid has two opposing longitudinal side edges; a longitudinal ridge at a medial position between the longitudinal side edges; a longitudinal beam extending below and along the length of longitudinal ridge; and a track wheel at each end of the longitudinal beam, said track wheel being engageable with either the first or second bin lid track; and bin lid actuation means;

in which the bin lid tracks define selected paths of travel for the track wheels, such that the bin lid actuation means can be operated to move the arched bin lid between:

a closed position in which each longitudinal side edge of the arched bin lid is proximal to the top of one of the sidewalls, with the track wheels being disposed within their corresponding bin lid tracks at a medial position between the sidewalls; and an open position in which a portion of the arched bin lid is positioned alongside and external to a first one of the sidewalls, with a first one of the longitudinal side edges being disposed above the top of the first one of the sidewalls, with the second one of the longitudinal side edges being disposed above the top of the first one of the sidewalls, and with the arched bin lid's track wheels being disposed within their corresponding bin lid tracks at a lateral position proximal to the lateral position of the first one of the sidewalls.

The geometric configuration of the arch lid may generally correspond to that of the previously-described clamshell lid assembly such that when a bin fitted with the arch lid is closed, it will look much the same as if it had been fitted with the clamshell lid assembly instead. The arch lid may be opened and closed using actuating mechanisms similar to those described previously in connection with the clamshell lid. The arch lid may be configured to open in one direction only (i.e., by providing a lid actuation mechanism in association with only one bin sidewall), or to be opened in either direction (i.e., by providing lid actuation mechanisms in association with both sidewalls).

BRIEF DESCRIPTION OF THE DRAWINGS

Embodiments will now be described with reference to the accompanying Figures, in which numerical references denote like parts, and in which.

DETAILED DESCRIPTION

Clamshell Lid Embodiments

Figure 1:
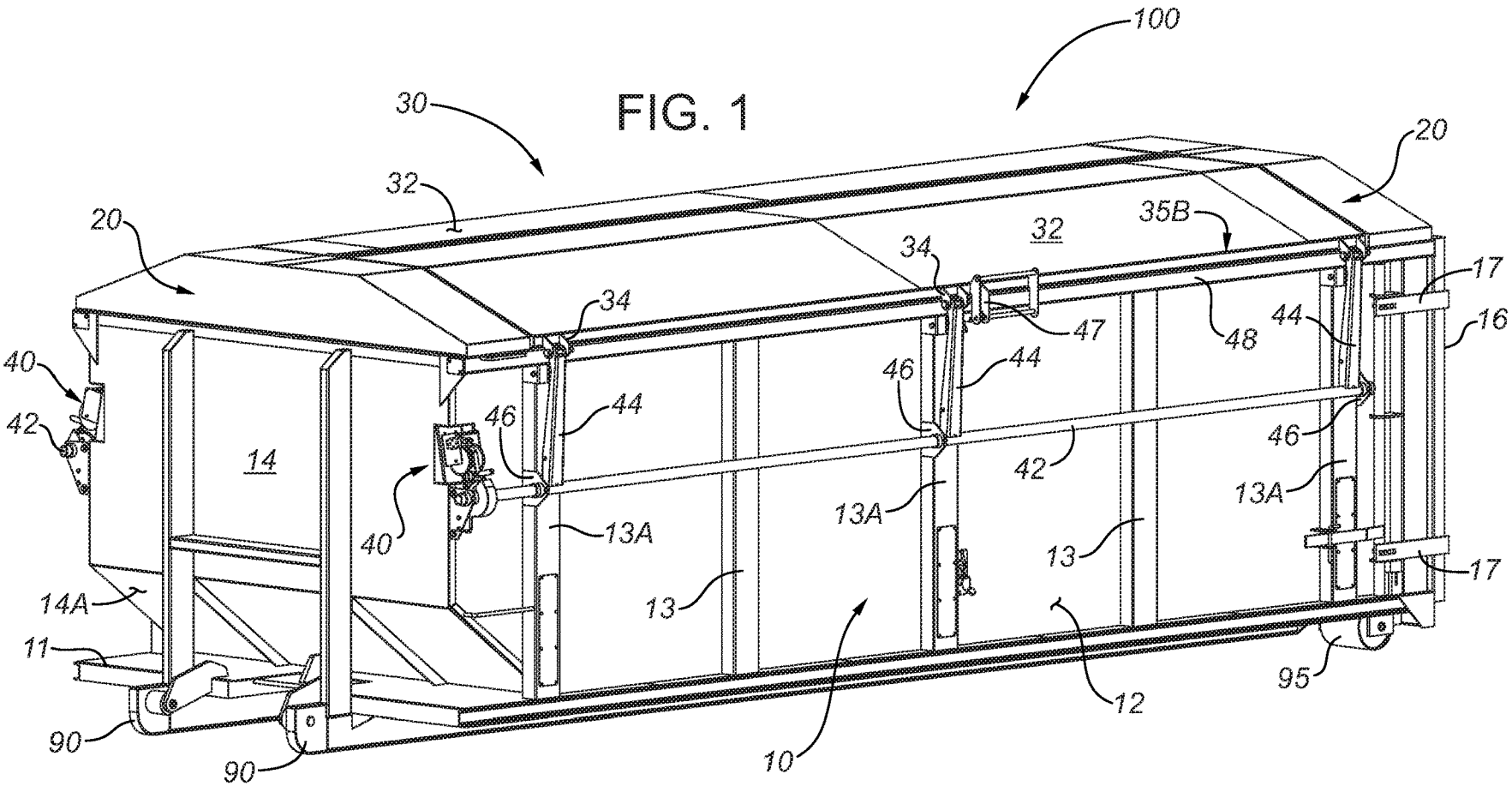
FIG. 1 is an isometric view of a roll-off bin having an embodiment of a clamshell lid assembly in accordance with the present disclosure, with the lid assembly shown in the closed position.
Figure 2:
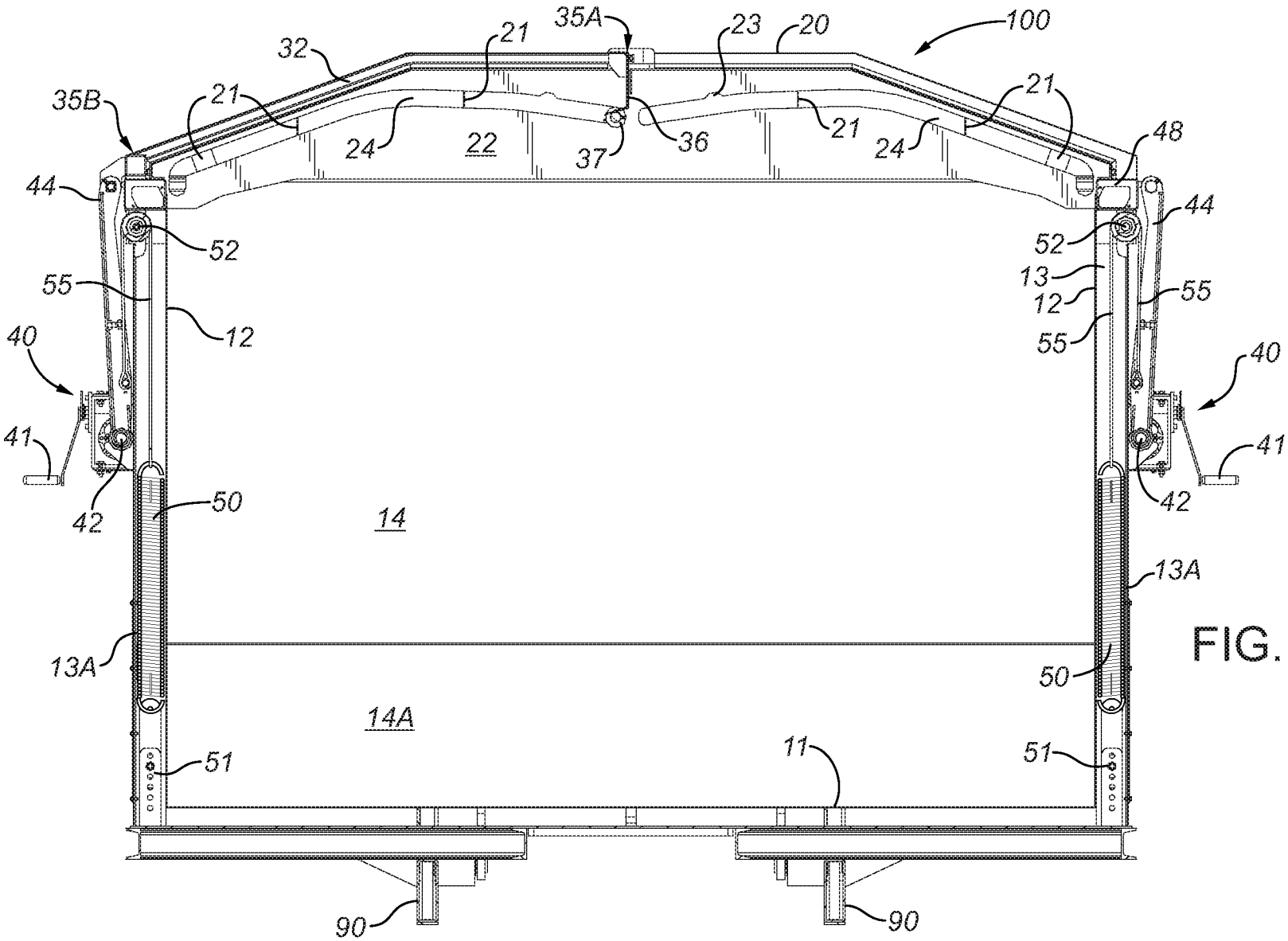
FIG. 2 is a transverse cross-section through the roll-off bin in FIG. 1, looking toward the bin's fixed endwall, illustrating the bin's track, with one of the lid panels shown in the closed position.
Figure 2A:
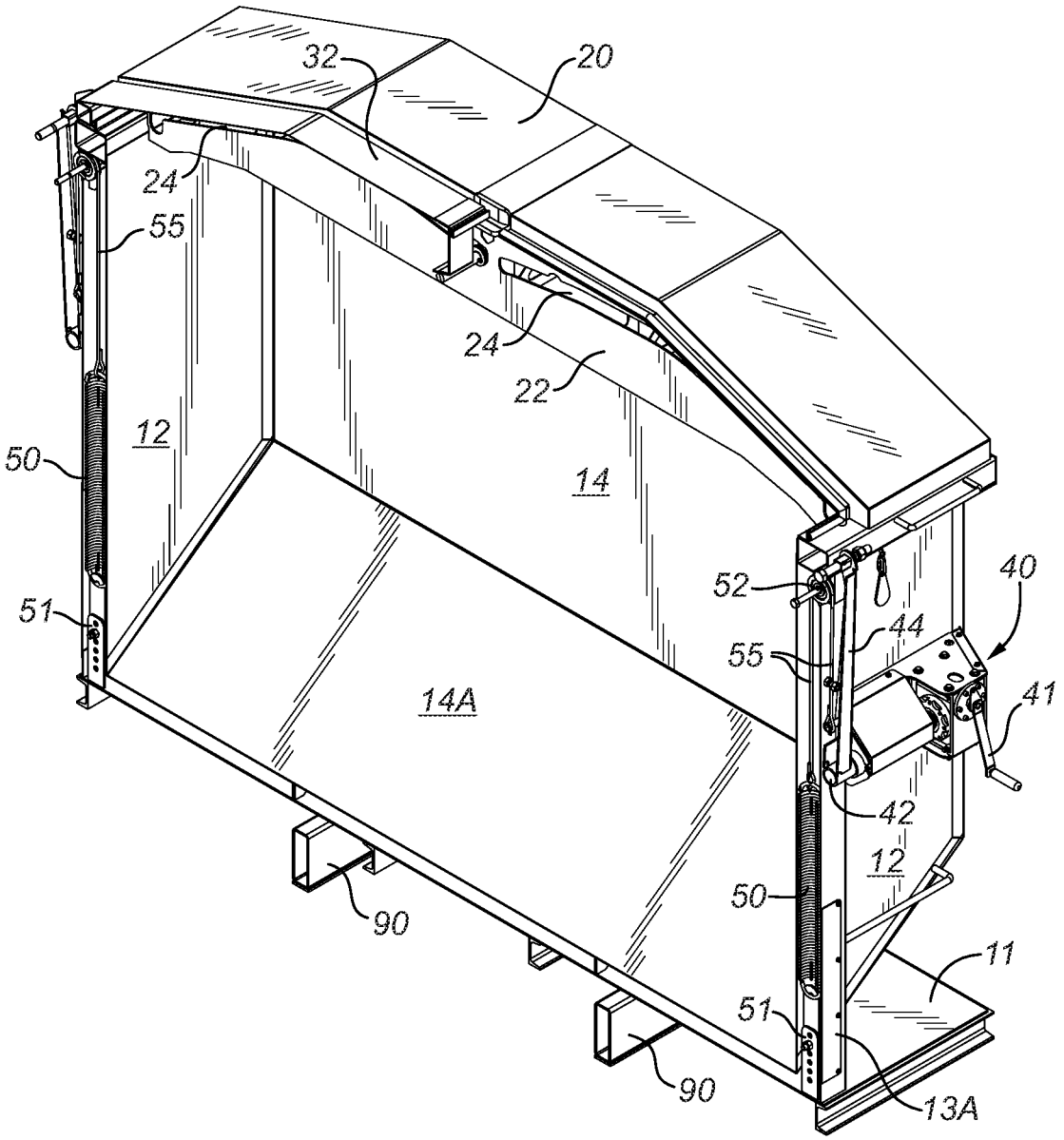
FIG. 2A is an isometric version of the cross-section in FIG. 2.

FIGS. 1, 2, and 2A illustrate a first embodiment 100 of a roll-off bin assembly in accordance with the present disclosure. Roll-off bin assembly 100 includes a generally rectangular open-top container 10, which comprises a rectangular floor structure 11 built upon longitudinal skid members 90, with a pair of longitudinal sidewalls 12 extending upward from floor structure 11 and extending horizontally between a first endwall 14 and a second endwall 16. In the illustrated embodiment, first endwall 14 is fixed, and optionally may have a sloped lower section 14A. Second endwall 16 optionally may be hinged on one side about a vertical axis defined by two or more hinges 17. A pair of wheels 95 are preferably mounted to skids 90 (or other components of floor structure 11) to facilitate maneuvering and positioning of roll-off bin 100.

Roll-off bin assembly 100 also includes a pair of track box structures 20, mounted at opposite ends of container 10 and extending above container sidewalls 12 and endwalls 14,16, so as to define a generally rectilinear (e.g., square or rectangular) bin roof opening defined by and extending between the inner faces of the track boxes 20 and the inner faces of sidewalls 12. As most clearly shown in FIGS. 4 and 4A, track boxes 20 will typically incorporate various internal structural elements shown by way of example as structural frames 21.

Roll-off bin assembly 100 further includes a bin lid assembly 30 comprising a pair of lid panels 32, which are movably engageable with the track boxes 20 (in a manner described in detail later herein) so as to be operable for selective opening and closing of the above-defined bin roof opening.

Figure 3:
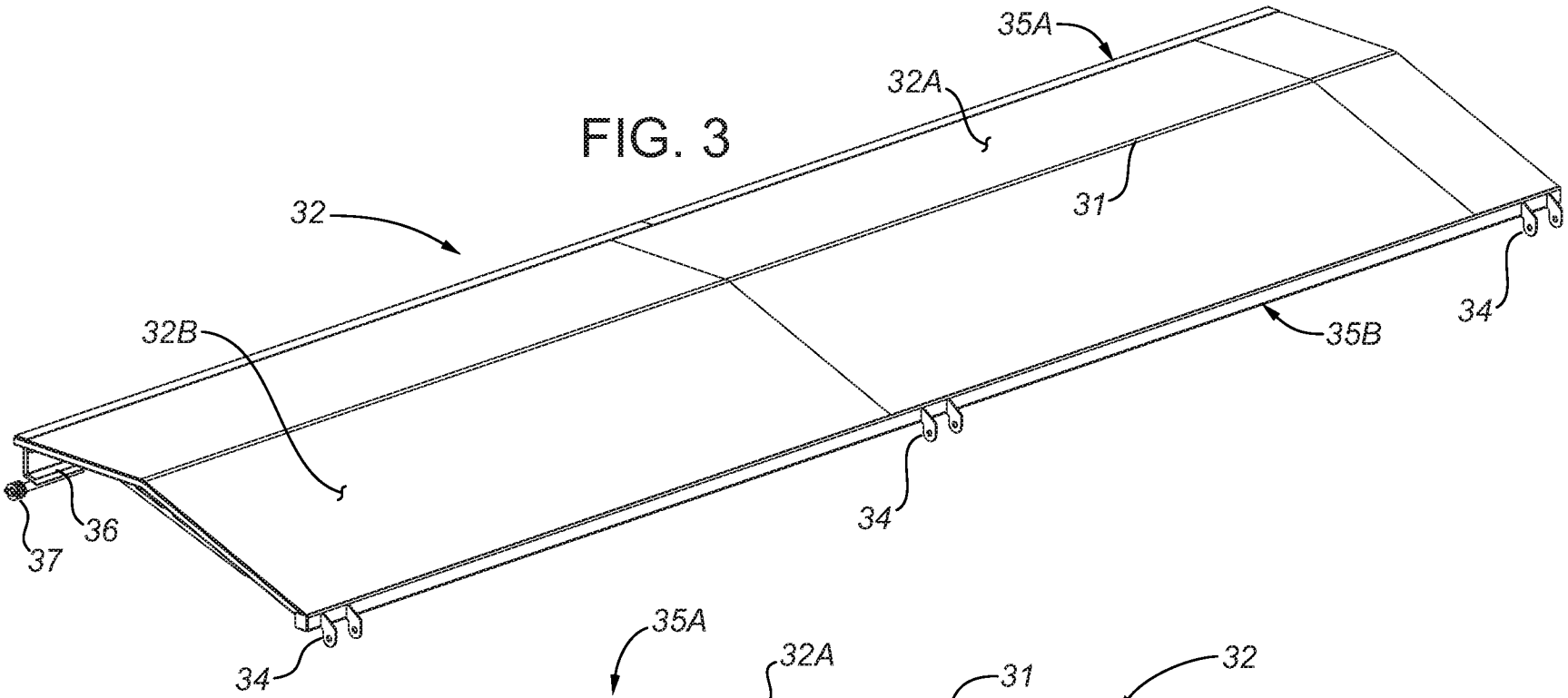
FIG. 3 is an isometric view of a clamshell lid panel as in the embodiment shown in FIGS. 1, 2, and 2A.
Figure 3A:
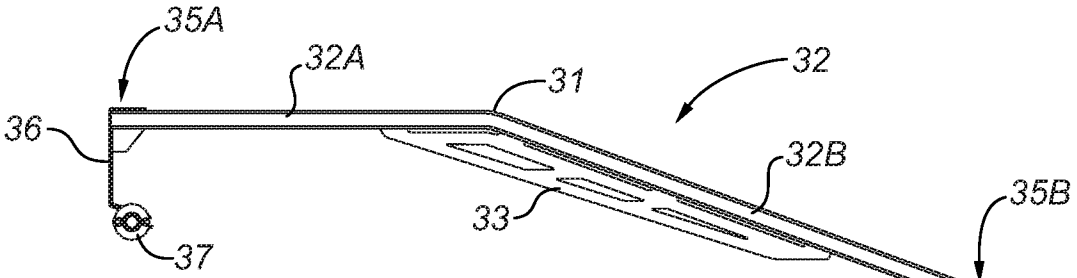
FIG. 3A is a transverse cross-section through the clamshell lid panel in FIG. 3.

In the exemplary and non-limiting embodiment shown in FIGS. 3 and 3A, each bin lid panel 32 comprises an inner subpanel 32A and an outer subpanel 32B that are contiguous with each other but angularly offset from each other along a longitudinal bend line 31. As a result of the angular offset between lid subpanels 32A and 32B, and as may be seen in FIGS. 1, 2, and 2A, when the two lid panels 32 have been mounted into bin assembly 100 and are positioned so as to close the bin roof opening, they will form a vaulted lid structure in which inner subpanels 32A are generally horizontal and outer subpanels 32B sloped away from inner subpanels 32A toward the top rails 48 of bin container sidewalls 12.

Also as shown in FIGS. 3 and 3A, a longitudinal beam member 36 is provided along the inner longitudinal edge 35A of each bin lid subpanel 32A, to provide sufficient structural strength to span between the track boxes 20 while carrying tributary dead loads (i.e., lid panel weight) and live loads (e.g., snow accumulation). FIG. 3A also shows transverse bracing or stiffening members 33 on the underside of lid panel 32; however, such auxiliary members will not necessarily be required in all cases, as the need for same will be a matter of structural design.

As further shown in FIGS. 3 and 3A, a selected number of pivot arm brackets 34 are provided at spaced intervals along the outer longitudinal edge 35B of each lid panel 32 (for purposes discussed later herein). As well, a track wheel 37 is provided at each end of the inner longitudinal edge 35A of each lid panel 32, for engagement with or within corresponding lid tracks 24 in track boxes 20 (as described below).

Figure 4:
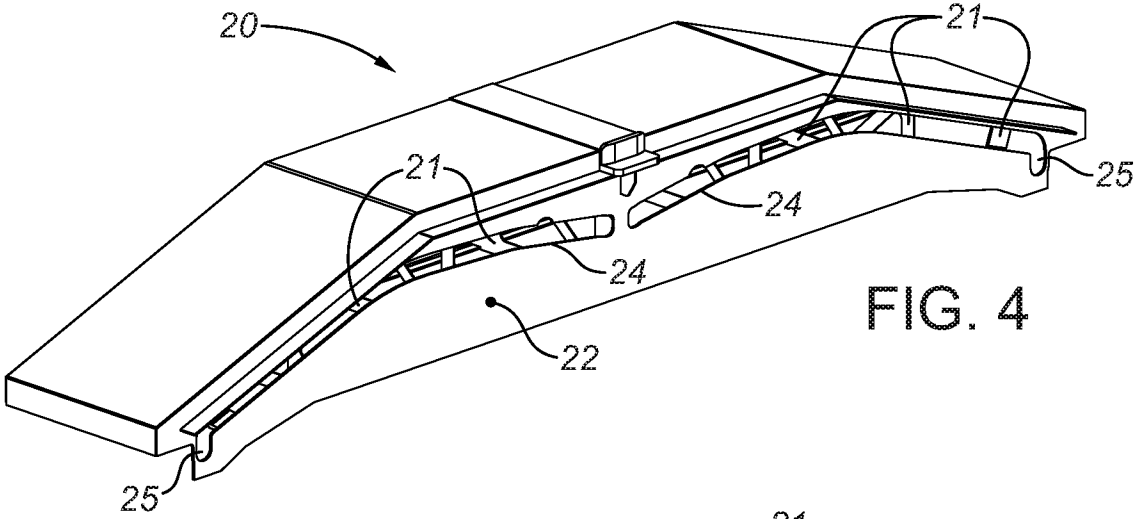
FIG. 4 is an isometric view of the track box structure shown in FIGS. 2 and 2A.
Figure 4A:
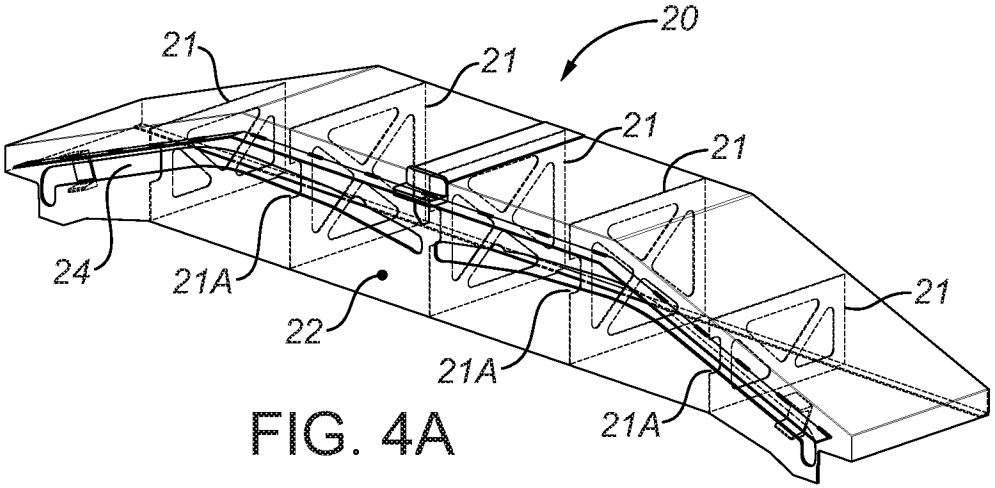
FIG. 4A is a further isometric view of the track box structure in FIGS. 2 and 2A, illustrating exemplary internal structural framing members.

Referring again to FIGS. 2 and 2A, and also to FIGS. 4 and 4A, each track box 20 includes an inner track box wall 22 carrying or defining a pair of lid tracks 24 engageable by track wheels 37 on the inner longitudinal edges 35A of bin lid panels 32 as previously described. Lid tracks 24 are thus configured to define selected paths of travel for the inner longitudinal edges 35A of lid panels 32 as lid panels 32 move between open and closed positions. As indicated by reference numbers 21A shown in FIG. 4A, structural members 21 of track boxes 20 may need to be notched where lid tracks 24 meet or pass structural members 21 to permit passage of track wheels 37.

Container sidewalls 12 typically will have a number of horizontally-spaced vertical stiffeners 13 to provide sidewalls 12 with required structural strength. In the illustrated embodiment, a selected number of these vertical stiffeners (designated by reference number 13A) on each sidewall 12 are modified to carry bearing assemblies 46 to support and to enable rotation of a horizontally-oriented bin lid actuation shaft 42, which is selectively rotatable by suitable shaft rotation means 40. In the illustrated embodiment, the shaft rotation means 40 is shown, by way of non-limiting example, as a gear arrangement operable by a manual crank 41.

A selected number of pivot arms 44 are welded or otherwise rigidly fixed to each lid actuation shaft 42 at spaced intervals, such that they are all perpendicular to shaft 42 and parallel to each other, such that rotation of either lid actuation shaft 42 will cause corresponding rotation of all of its associated pivot arms 44. As perhaps best understood from FIGS. 1 and 5B, the free end of each pivot arm 44 is pivotably mounted to a corresponding one of the pivot brackets 34 on one of the bin lid panels 32. Accordingly, when a given one of the bid lid panels 32 is in the closed position (as shown in FIG. 1 or FIG. 2), rotation of the corresponding lid actuation shaft 42 and resultant outward movement of the free ends of the associated pivot arms 44 will pull the outer longitudinal edge 35B of the lid panel 32 outward and away from the associated bin sidewall 12. For convenience, lid actuation mechanism generally as described in this paragraph may be alternatively referred to herein as side arm control systems (or SACS).

At the same time, the track wheels 37 on the inner longitudinal edge 35A of the lid panel 32 will travel along the corresponding lid tracks 24 in track boxes 20. Continued rotation of lid actuation shaft 42 and its pivot arms 44 will ultimately cause track wheels 37 to drop into end pockets 25 provided in outer terminal regions of lid tracks 24, so as to allow the inner longitudinal edge 35A of lid panel 32 to extend beyond the outer face of bin sidewall 12 and to drop to or below the level of top rail 48 on sidewall 12, thus allowing lid panel 32 to lie vertically alongside the exterior of sidewall 12, preferably without any portion of lid panel 32 projecting above sidewall 12.

As shown in FIGS. 2 and 2A, bin assembly 100 preferably includes one or more helical springs 50 mounted in association with each bin lid panel 32, for purposes of reducing forces required to close the panel and for regulating the speed of the panel's movement during the lid-opening cycle. These beneficial effects are achieved in the illustrated embodiments by anchoring one end of each helical spring 50 to an anchorage point 51 in the bin sidewall structure, running a cable 55 from the top of spring 50 over a pulley 52 mounted near the top of bin sidewall 12, and attaching the other end of cable 55 to one of the pivot arms 44 at a selected radial distance from the associated actuation shaft 42. FIGS. 1, 2, and 2A illustrate each of springs 50 being enclosed in a tubular stiffener 13A, with each stiffener 13A having a removable panel for access to spring 50 and anchorage point 51. However, this is by way of non-limiting example only. In alternative embodiments, one or more of the helical springs 50 could be exposed rather than enclosed inside a sidewall stiffener.

As shown in FIG. 1, a lid locking mechanism 47 may optionally be provided at one or more locations along the juncture between each lid panel 32 and the corresponding sidewall top rail 48. In FIG. 1, lid locking mechanism 47 is generally shown as including a pair of mating brackets, one on lid panel 32 and one on top rail 48, for receiving a padlock or other locking device. However, this is by way of non-limiting example; persons of ordinary skill in the art will appreciate that suitable lid locking mechanisms could be provided in numerous alternative forms using known technologies.

Bins with clamshell lid assemblies in accordance with the present disclosure can provide a variety of advantages and benefits over prior art bin and lid technologies, including the following:

- The high arch in the center where the lid panels meet in the closed position allows for bin contents to be heaped higher than the sidewall without interfering with closure of the lids.
- A lower region of the track box at the hinged endwall can be contoured to facilitate dumping of heaped bin contents without interference with the track box.
- The clamshell lid panels can be designed to be manually operated by hand, manually operated with an extension handle, or winch operated, with each of these options having benefits in particular operational situations:
  - Manual lid operation by hand may be desirable on bins with low sidewalls where the operator can comfortably reach the handle; this capability enables faster lid opening and closing, virtually effortlessly due to the spring assist.
  - Manual lid operation with an extension handle, and/or by winch operation, can also be used on low-wall bins by operators having comparatively low physical strength and/or agility. These modes of operation could also be used for bins having sidewalls that are too high to allow an operator to reach the lid panels; in such cases, the winch would be mounted below the lid actuation shaft in a location that the operator can comfortably reach.
- The "track and pivot arm" lid mechanism design results in the bin having a much lower side profile when the clamshell lid panels are in the open position than is the case with conventional bin lid designs, because each open clamshell lid panel is tucked up neatly against the corresponding bin sidewall. At the same time, the open lid panel does not impede users from getting close to the bin to dispose of materials.
- Unlike conventional winch lids and rolling lids, which in the open position protrude above the bin and thus present large flat surfaces exposed to the wind, the clamshell lid design has a low profile throughout the opening and closing cycles. The clamshell lid can never get into a runaway situation where the wind will take control of it. As the clamshell lid panels move more toward the open position, an increasingly larger portion of their surface area becomes protected by the associated bin sidewall, to the point where the lid surface area exposed to wind is reduced to zero or nearly so. In fact, the total exposed side profile area of the bin is less when the lids are open than it is when the lids are closed.
- In some embodiments, the disclosed clamshell lid assembly may be configured such that when a given one of the lid panels 32 is in the open position, it effectively hangs on the associated bin sidewall 12. The beam 36 provided along the inner longitudinal edge 35A of panel 32, which acts as a structural support member spanning the length of panel 32 when panel 32 is in any position other than the open position, acts like a cap member when panel 32 is in the open position, which provides a number of benefits. In this position, beam 36 is oriented with its primary structural strength available to resist lateral loads acting on lid panel 32. With beam 36 resting on sidewall 12 and lid stiffeners 33 resting against the outside face of sidewall 12, sidewall 12 and lid panel 32, in combination, effectively provide increased structural resistance to undesirable but perhaps inevitable lateral impact loads that might result, for example, from persons careless dumping large awkward objects (e.g., old furniture items) into the bin, or banging the edge of the bin with heavy objects (e.g., chunks of concrete). In this orientation, beam 36 can also help to keep unwanted debris off of sidewall top surfaces, thus helping to prevent such debris from interfering from bin lid closure, particularly where the clearance between the top of the sidewall and the end of the lid panel in the closed position is minimal.
- The disclosed clamshell lid configuration makes it possible to open the two lid panels independently of each other, or to open only one panel if desired, which will often be the case where only small amounts of refuse material need to be loaded into the bin, and/or where only a few daily trips to the bin are required.
- The clamshell lid also avoids a particular drawback of rolling lids, which require the user to open the lid from a first side of the bin, then to walk over to the second side of the bin to deposit waste material into the bin, and then to go back to the first side of the bin to close the lid. In contrast, the clamshell lid can be opened on whichever side the user wishes to load material into the bin from. This feature is very desirable in areas where one side of the bin needs to be in close proximity to a fence, structure, vehicle, snowpile, or other obstruction that impedes bin access or lid operation (for example, a rolling bin would not be usable in such situations).
- In the exemplary but non-limiting embodiment illustrated in FIGS. 1-5C, lid tracks 24 are provided as slots formed in a comparatively thin but sufficiently strong metal plate incorporated into inner track box wall 22, such that lid track wheels 37 run on a thin metal edge that is not prone to accumulate or be hindered by foreign debris such as gravel or snow. In contrast, typical rolling lid tracks are not protected from the elements and therefore are susceptible to accumulation of debris that can hinder smooth rolling movement of V-grooved wheels commonly used on rolling lids.
- The clamshell lid design is readily adaptable to receive effective seals for use with bins that are required to be liquid-tight and/or vapor-tight—such as, for example, where toxic fumes or unpleasant odors from rotting waste need to be contained, or where bin contents need to be protected from entry of outside contaminants (e.g., rain).

Although the illustrated embodiments incorporate a pair of clamshell lids, alternative embodiments of roll-off bins in accordance with the present disclosure could include only one movable clamshell lid, with a portion of the bin having a permanent roof.

Arch Lid Embodiments

Figure 5A:
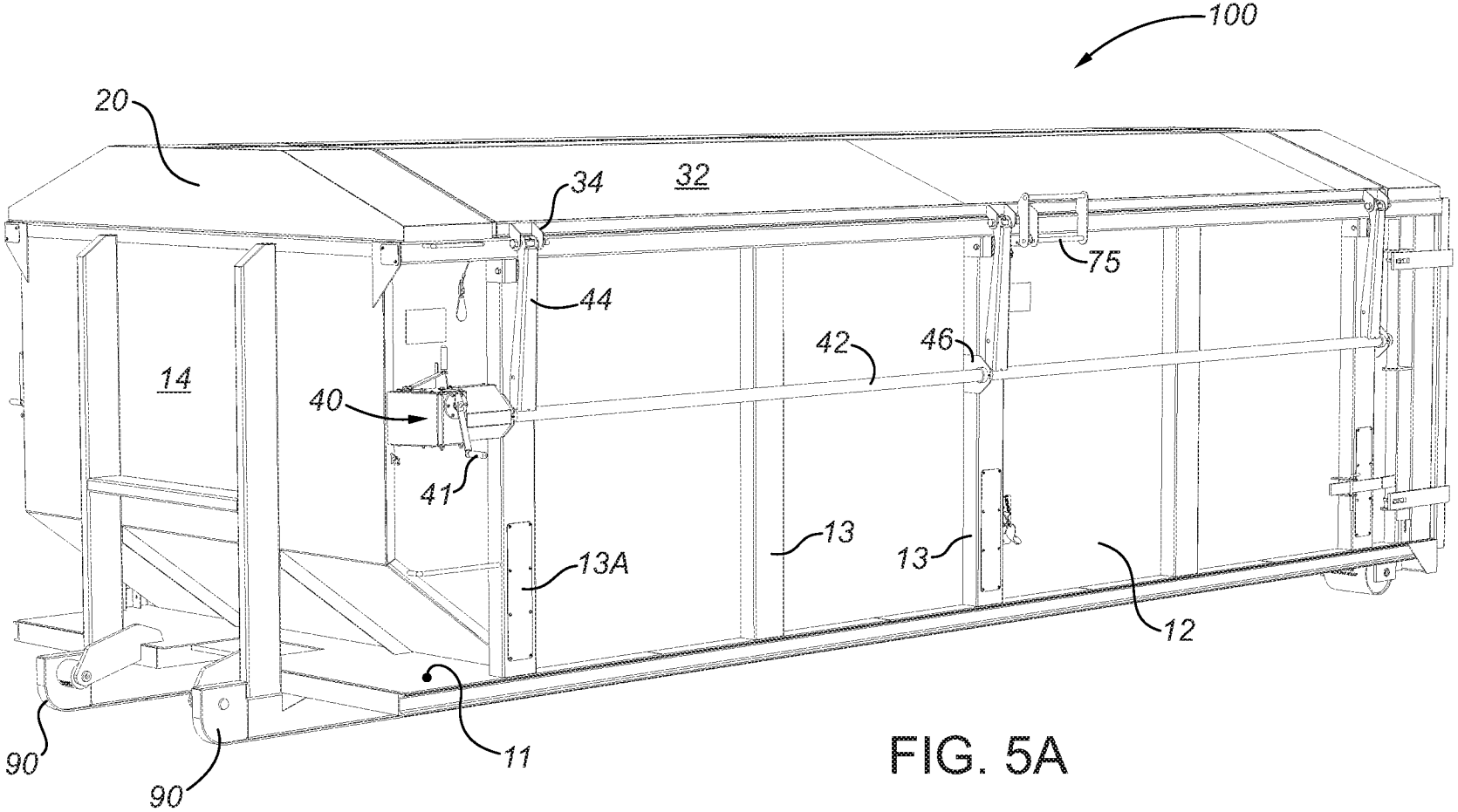
FIG. 5A is a perspective view of an embodiment of a roll-off bin in accordance with the present disclosure, shown with both clamshell lid panels in the closed position.
Figure 5B:
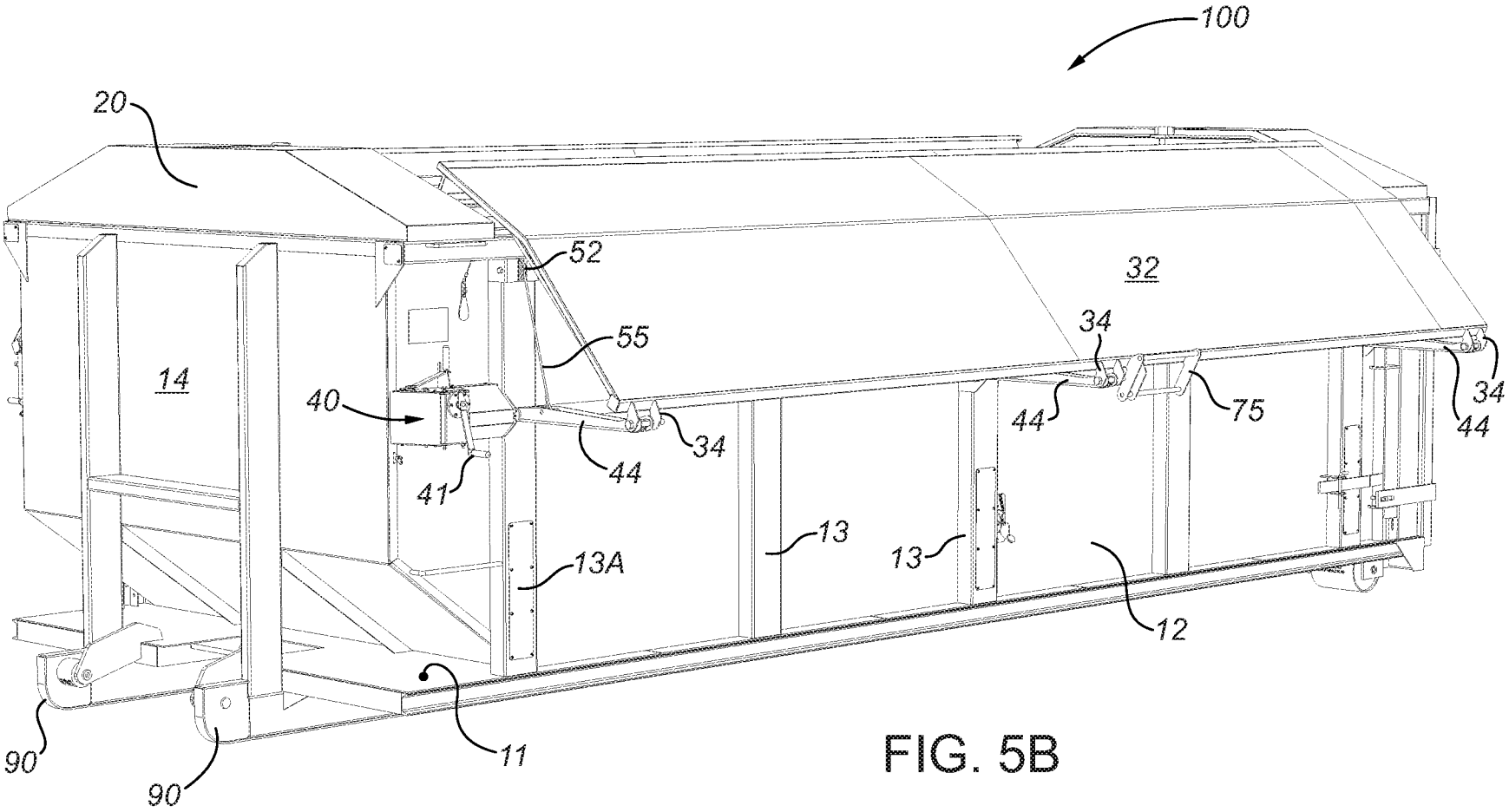
FIG. 5B is a perspective view of the roll-off bin in FIG. 5A, shown with both clamshell lid panels transitioning from the closed position toward the open position, and illustrating a counterweight spring and cable assembly mounted between the bin's base structure and the pivot arms on the lid actuation shaft.
Figure 5C:
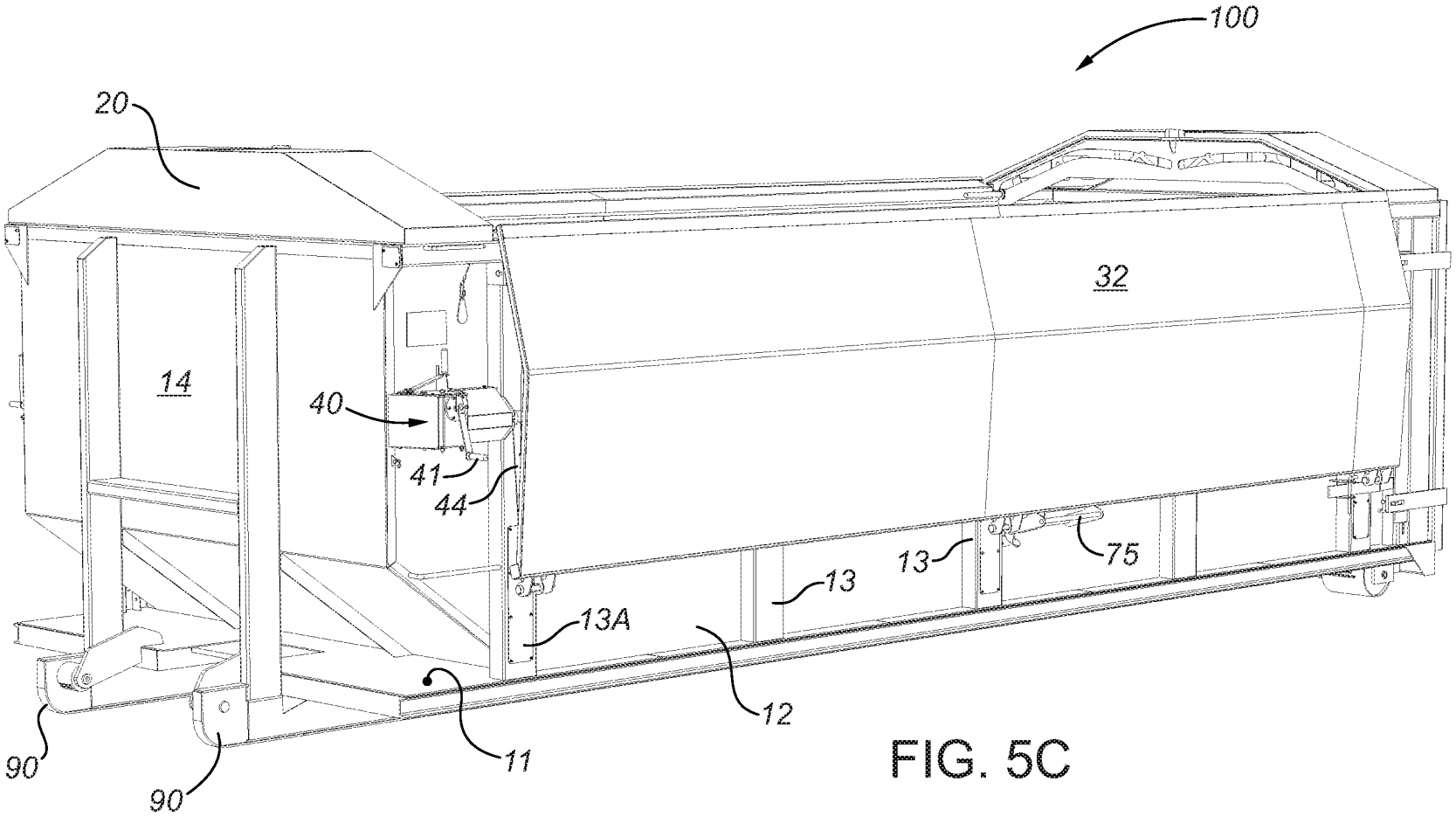
FIG. 5C is a perspective view of the roll-off bin in FIGS. 5A and 5B, shown with both clamshell lid panels in the open position.

FIGS. 6-9 illustrate an alternative embodiment 200 of a roll-off bin generally similar to bin 100 as seen in FIGS. 1, 2, and 5A, and having various components in common with roll-off bin 100 (and indicated with the same reference numbers), but fitted with a single-panel "arch lid" 230 that in the closed position extends across the full bin width between the two sidewalls 12.

Figure 6:
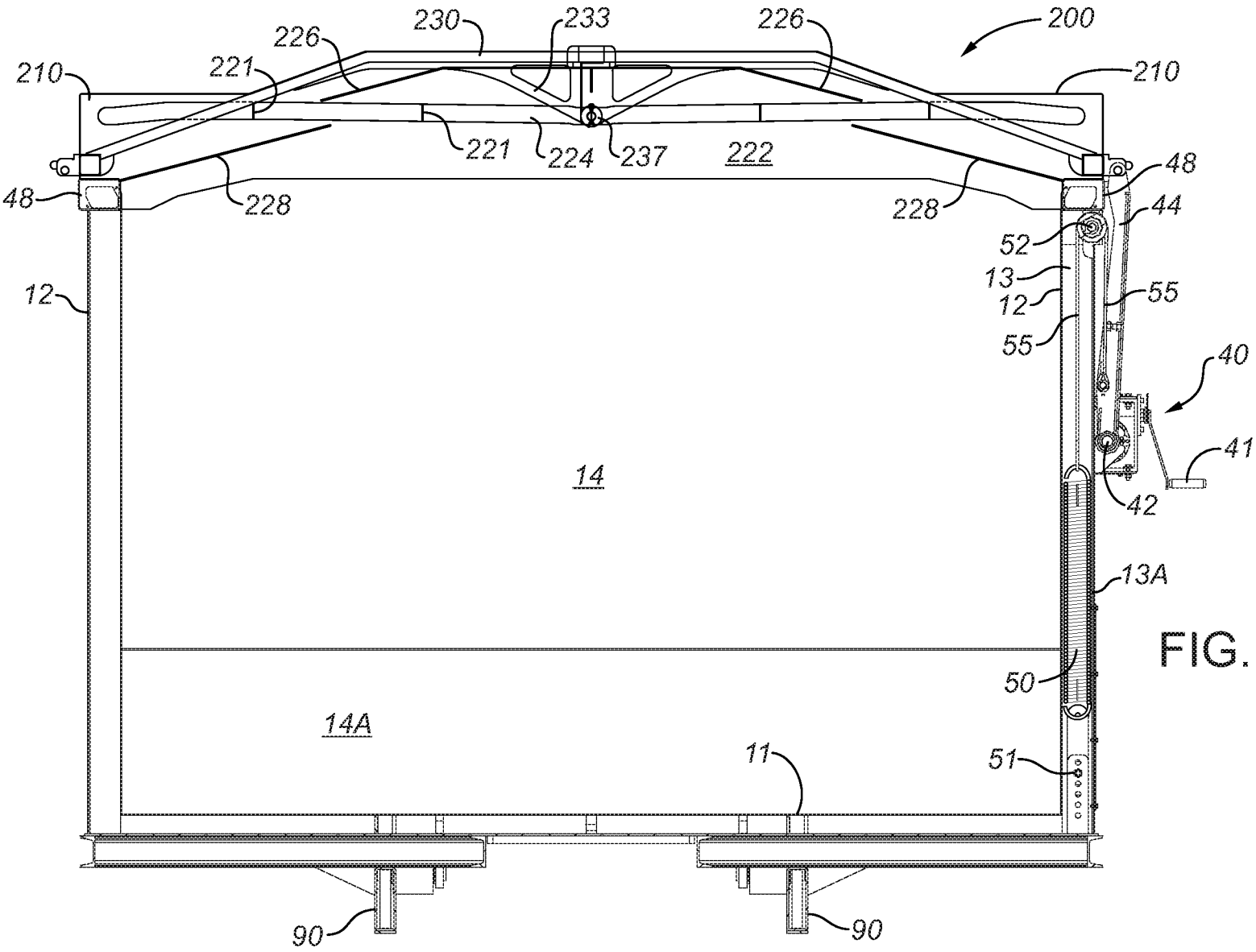
FIG. 6 is a transverse cross-section through a roll-off bin generally as in FIG. 1, but fitted with an embodiment of an arch lid in accordance with the present disclosure, configured to open and close in one direction only, and shown with the arch lid in the closed position.
Figure 7:
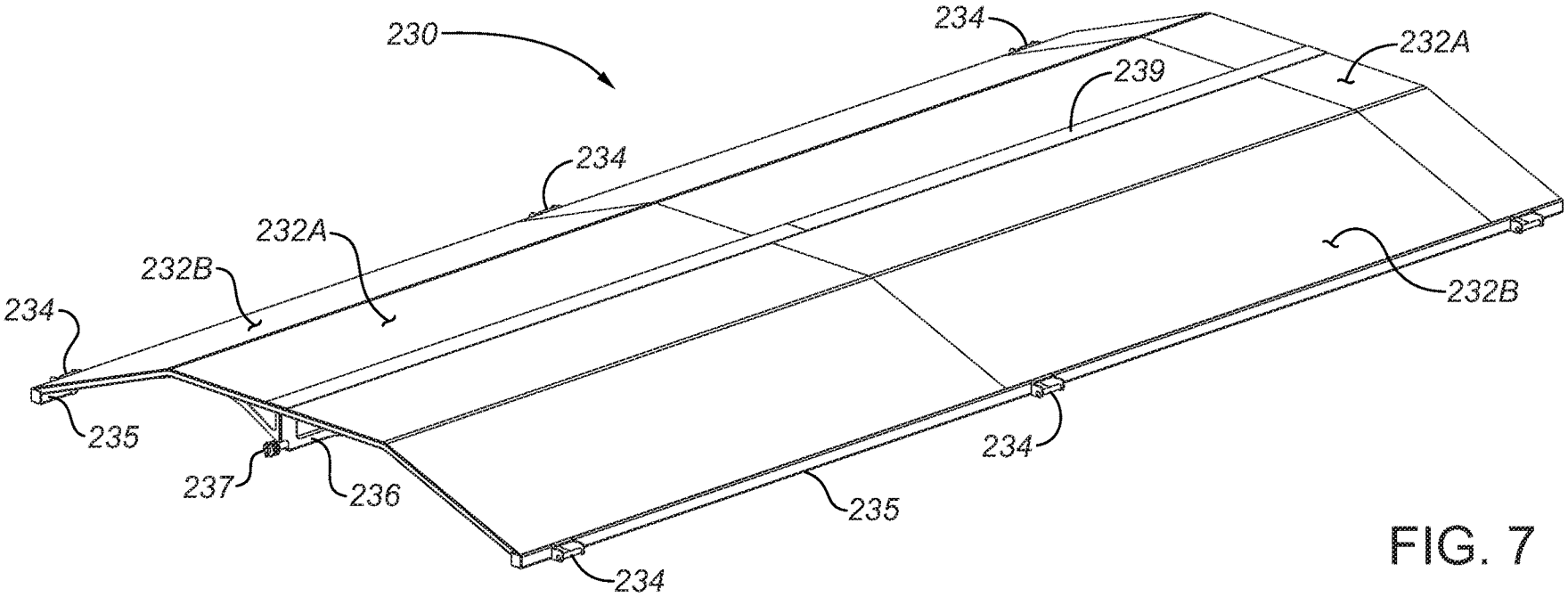
FIG. 7 is an isometric view of the arch lid in FIG. 6.

As best appreciated with reference to FIGS. 6 and 7, arch lid 230 essentially corresponds to two "clamshell" lid panels 32 as in FIGS. 3 and 3A, but rigidly connected along their inner longitudinal edges (reference numbers 35A in FIGS. 3 and 3A) along a longitudinal ridge line 239 in arch lid 230. Accordingly, various elements of arch lid 230 match corresponding elements of clamshell lid panels 32, and are referred to in the Figures by the same reference numbers but with the prefix "2" added for differentiation purposes with reference to arch lid 230: for example, the inner subpanels 232A, outer subpanels 232B, and pivot brackets 234 (and so on) of arch lid 230 generally correspond, respectively, to the inner subpanel 32A, outer subpanel 32B, and pivot brackets 34 of clamshell lid panels 32 (and so on).

Whereas each clamshell lid 32 has a structural beam member 36 along its inner longitudinal edge 35A, with a track wheel 37 at each end of beam 36, arch lid 230 has a single structural beam member 236 running along the underside of lid 230 below ridge line 239, with a single track wheel 237 being provided at each end of beam member 236, as best seen in FIG. 7 Beam member 236 may have stiffening members 233 as shown in FIG. 6, as may be dictated by structural design considerations.

Figure 8:
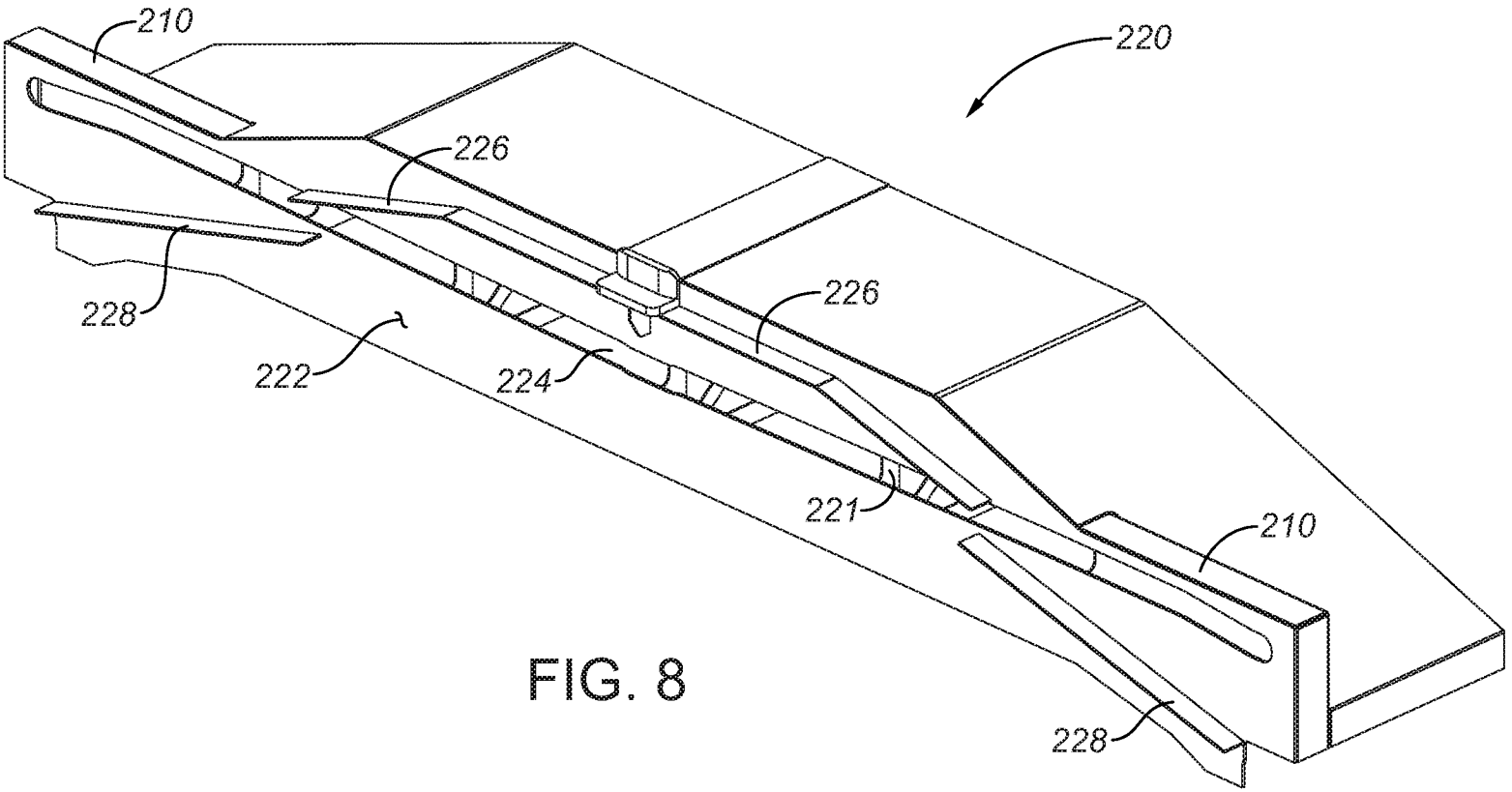
FIG. 8 is an isometric view of the track box structure of the roll-off bin in FIG. 6.
Figure 9:
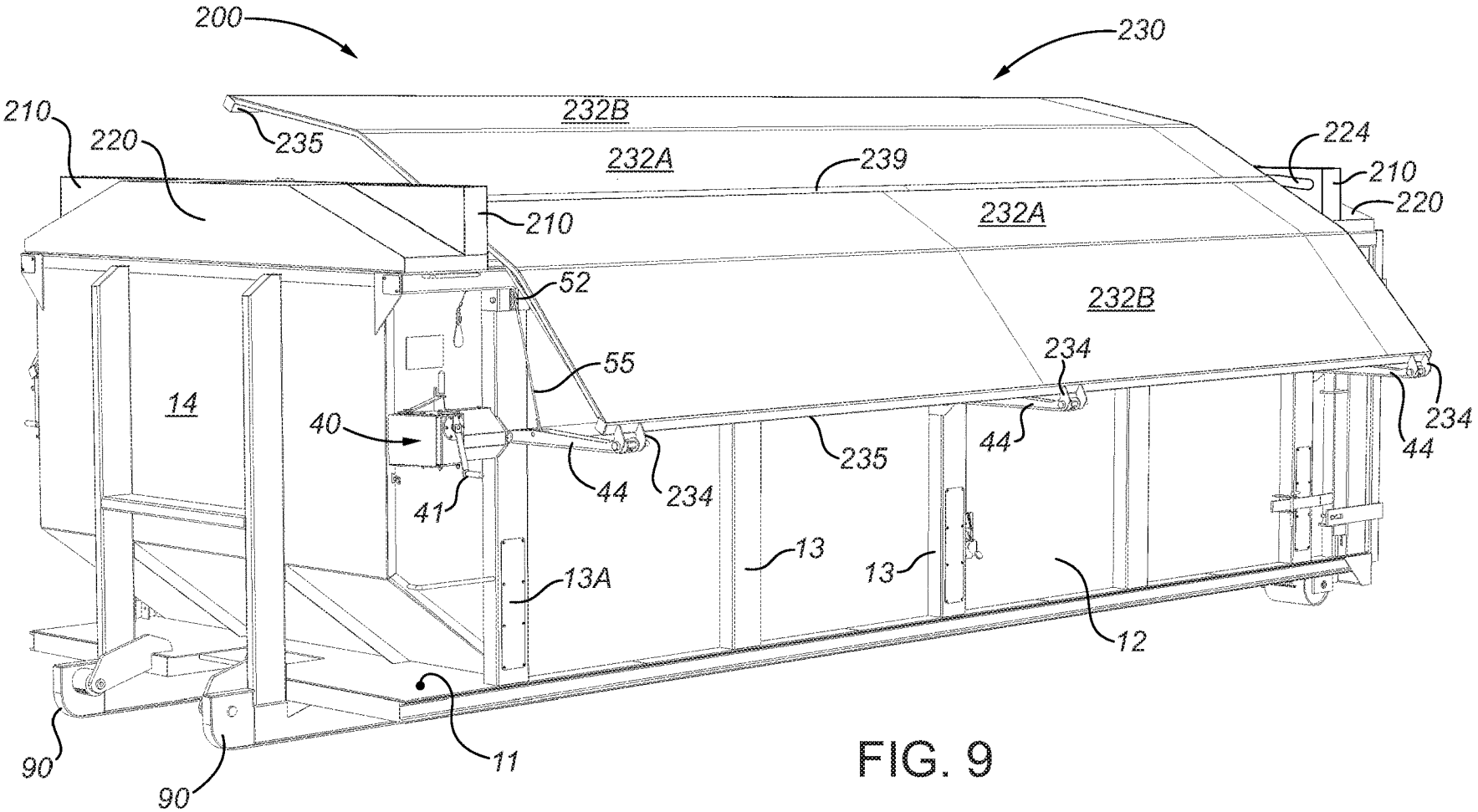
FIG. 9 is a perspective view of a roll-off bin having an arch lid as in FIG. 6, shown with the arch lid transitioning between the open and closed positions.

As shown in FIG. 8, each end of bin 200 incorporates a track box structure 220 having an inner track box wall 222 carrying or defining a lid track 224 engageable by one of the track wheels 237 on arch lid 230. In cases where it is desired to enable substantially the full horizontal area of bin 200 to be exposed when arch lid 230 is in the open position, it may be necessary or desirable to provide the track box structures 220 on one or both sides of gin 200 with track box extensions 210 as shown in FIG. 8, so that lid tracks 224 can extend sufficiently outboard of a selected one (or either) of the bin sidewalls 12 that arch lid 230 can be oriented in a substantially vertical position adjacent the exterior of the sidewall toward which arch lid 230 moves while being opened.

As shown in FIG. 8, it may be necessary in some embodiments for track box extensions 210 to project above the general roofline of track box structures 220, and the associated lid tracks 224 will extend laterally beyond the track box structures' roofline.

In such embodiments, it may be desirable to provide track box structures 220 with optional flashing elements 226 and 228 (as shown by way of example in FIG. 8, or in other functionally effective form) to prevent or minimize potential infiltration of rainwater or snow into bin 200 in the region where lid tracks 224 intersect the track box structures' roofline.

As shown by way of example in FIG. 6, bin 200 may be configured to allow arch lid 230 to be opened in one direction only, by providing a lid actuation mechanism (shown by way of non-limiting example in FIG. 6 in the form of a SACS comprising lid actuation shaft 42, pivot arms 44, shaft rotation means 40, helical springs 50, cables 55, etc.) in association with only one sidewall 12 of bin 200. In alternative embodiments, however, lid actuation mechanisms may be provided in association with both bin sidewalls 12 in order to allow arch lid 230 to be opened in either direction. In such alternative embodiments, it may be necessary or desirable to provide bin 200 with suitable means for temporarily disconnecting or disabling a selected one of the lid actuation mechanisms to enable use of the other lid actuation mechanism. To provide one non-limiting example of this, a suitable quick-release mechanism, using known technologies, could be provided in association with pivot arms 44 to disengage them from pivot brackets 234 on the longitudinal side edges 235 of arch lid 230.

Roll-off bins with arch lids in accordance with the present disclosure provide a number of advantages over bins with conventional types of lids. For example, the arch lid can close over and conceal a load of material that is heaped above the top of the bin sidewalls. Combining a track and wheel system with a side arm control system (SACS) elevates the ridgeline 239 of arch lid 230 well above the height of bin sidewalls 12. During the operations of opening and closing arch lid 230, this system controls and directs the "free" longitudinal side edge 235 of arch lid 230 to rise over the heaped bin contents and then down into the position for locking; meanwhile, the ridge of arch lid 230 remains well clear of the bin contents. In contrast, a rolling lid on a roll-off bin cannot be closed easily or at all unless the material disposed therein is entirely below the level of the underside of the rolling lid, because a rolling lid can only move in a horizontal plane.

When arch lid 230 is closed, with all of the SACS release mechanisms in the locked position (i.e., such that all pivot arms 44 are in locking engagement with corresponding pivot brackets 234 on longitudinal side edges 235 of arch lid 230), arch lid 230 will be prevented from coming open inadvertently. Bin 200 can then be securely transported without need for strapping or ratchet straps or other auxiliary means commonly used to secure conventional bin lids during transport.

Optionally, arch lid 230 can be further secured against unauthorized intentional opening by installing one or more padlocks or other locking means provided in association with pivot arms 244 and pivot brackets 234. Because movement of arch lid 230 is constrained by the engagement of track wheels 237 with lid tracks 224, even a single effective lock on only one side of bin 200 will prevent lid 230 from opening.

Although clamshell lids and arch lids in accordance with the present disclosure have been described and illustrated in association with roll-off bins, this is by way of non-limiting example only, as lid embodiments in accordance with the present disclosure can be readily adapted for use with other types of bins or containers, including bins or containers intended for purposes and uses unrelated to common purposes and uses of roll-off bins.

It will be readily appreciated by those skilled in the art that various modifications to embodiments in accordance with the present disclosure may be devised without departing from the scope of the present teachings, including modifications which may use equivalent structures or materials hereafter conceived or developed. It is to be especially understood that the scope of the present disclosure is not intended to be limited to described or illustrated embodiments, and that the substitution of a variant of a claimed or illustrated element or feature, without any substantial resultant change in functionality, will not constitute a departure from the scope of the disclosure.

In this patent document, any form of the word "comprise" is to be understood in its non-limiting sense to mean that any element or feature following such word is included, but elements or features not specifically mentioned are not excluded. A reference to an element or feature by the indefinite article "a" does not exclude the possibility that more than one of such element or feature is present, unless the context clearly requires that there be one and only one such element or feature. Any use of any form of the terms "connect", "engage", "couple", "attach", or any other term describing an interaction between elements is not meant to limit the interaction to direct interaction between the subject elements, and may also include indirect interaction between the elements such as through secondary or intermediary structure.

Relational and conformational terms such as "horizontal", "vertical", "parallel", and "rectilinear" are not intended to denote or require absolute mathematical or geometrical precision. Accordingly, such terms are to be understood as denoting or requiring substantial precision only (e.g., "substantially parallel" or "generally rectilinear") unless the context clearly requires otherwise. Wherever used in this document, the terms "typical" and "typically" are to be interpreted in the sense of representative of common usage or practice, and are not to be understood as implying essentiality or invariability.

What is claimed is:

1. An open-top bin comprising:

(a) a floor, a first endwall, a second endwall, and a pair of opposing longitudinal sidewalls, wherein said endwalls and sidewalls extend upward from the floor, and each sidewall extends between the first and second endwalls;

(b) a first track box structure extending vertically above and horizontally between the sidewalls, and extending horizontally from the first endwall to a first inner track box wall, wherein said first inner track box wall carrying a first bin lid track;

(c) a second track box structure extending vertically above and horizontally between the sidewalls, and extending horizontally from the second endwall to a second inner track box wall, so as to define a bin roof opening bounded by the sidewalls and the first and second inner track box walls, and wherein said second inner track box wall carries a second bin lid track corresponding to the first bin lid track;

(d) a bin lid assembly comprising a pair of bin lid panels configured to cover, in combination, substantially the full area of the bin roof opening, wherein at least one of the bin lid panels is a movable bin lid panel having:

an inner longitudinal edge and an outer longitudinal edge;

a longitudinal beam extending below and along the length of said inner longitudinal edge; and a track wheel at each end of the longitudinal beam, said track wheel being engageable with either the first or second bin lid track; and (e) bin lid actuation means associated with each movable bin lid panel;

wherein:

(f) the bin lid tracks define selected paths of travel for the inner longitudinal edge of the movable bin lid panels, such that the bin lid actuation means can be operated to move the movable bin lid panel between:

a closed position in which the outer longitudinal edge of the movable bin lid panel is proximal to the top of one of the sidewalls, with the bin lid panel's track wheels being disposed within their corresponding bin lid tracks at a medial position between the sidewalls; and an open position in which the movable bin lid panel is positioned alongside and external to the associated sidewall, with the movable bin lid panel's track wheels being disposed within their corresponding bin lid tracks at a lateral position proximal to the lateral position of the associated sidewall; and (g) the bin lid actuation means comprises a horizontally-oriented bin lid actuation shaft mounted to the exterior of the associated bin sidewall, said bin lid actuation shaft being selectively rotatable by a shaft rotation means; and at least one pivot arm rigidly fixed at a first end thereof to the lid actuation shaft, and pivotably mounted at a second end thereof to a pivot bracket attached to the outer longitudinal edge of the movable bin lid panel; such that:

rotation of the bin lid actuation shaft in a first direction, when the movable bin lid panel is in the closed position, will move the outer longitudinal edge of the movable bin lid panel outward and downward away from the top of the associated bin sidewall, with the movable bin lid panel's track wheels correspondingly moving laterally outward within their corresponding bin lid tracks, thus moving the movable bin lid panel toward the open position; and rotation of the lid actuation shaft in a second direction opposite to the first direction, when the movable bin lid panel is in a position other than the closed position, will move the outer longitudinal edge of the movable bin lid panel inward and upward toward the top of the associated bin sidewall, with the movable bin lid panel's track wheels correspondingly moving laterally inward within their corresponding bin lid tracks, thus moving the movable bin lid panel toward the closed position.

2. An open-top bin as in claim 1 wherein the shaft rotation means comprises a crank-operated gearbox.

3. An open-top bin as in claim 1, further comprising counterweighting means.

4. An open-top bin as in claim 3 wherein the counterweighting means comprises:

(a) one or more helical springs mounted in association with at least one of the at least one movable bin lid panels, with each of said one or more helical springs being anchored at a first end thereof to an anchorage point on the bin wall;

(b) a cable attached at one end thereof to a second end of each of the one or more helical springs, extending over a pulley mounted proximal to the top of the bin sidewall, and attached at a second end thereof to one of the pivot arms at a selected radial distance from the bin lid actuation shaft.

5. An open-top bin as in claim 1 wherein the bin lid assembly defines a vaulted roof structure when each of the one or more movable bin lid panels is in the closed position.

6. An open-top bin as in claim 1 wherein both of the bin lid panels are movable bin lid panels as defined in clause (d) of claim 1.

7. An open-top bin as in claim 6 wherein separate first and second bin lid tracks are provided in association with each of the bin lid panels.

8. An open-top bin as in claim 6 wherein each of the first and second bin lid tracks is a single track configured to accommodate track wheels of both bin lid panels.

9. An open-top bin comprising:

(a) a floor, a first endwall, a second endwall, and a pair of opposing longitudinal sidewalls, wherein said endwalls and sidewalls extend upward from the floor, and each sidewall extends between the first and second endwalls;

(b) a first track box structure extending vertically above and horizontally between the sidewalls, and extending horizontally from the first endwall to a first inner track box wall, wherein said first inner track box wall carrying a first bin lid track;

(c) a second track box structure extending vertically above and horizontally between the sidewalls, and extending horizontally from the second endwall to a second inner track box wall, so as to define a bin roof opening bounded by the sidewalls and the first and second inner track box walls, and wherein said second inner track box wall carries a second bin lid track corresponding to the first bin lid track;

(d) a bin lid assembly comprising a pair of bin lid panels configured to cover, in combination, substantially the full area of the bin roof opening, wherein at least one of the bin lid panels is a movable bin lid panel having:

an inner longitudinal edge and an outer longitudinal edge;

a longitudinal beam extending below and along the length of said inner longitudinal edge; and a track wheel at each end of the longitudinal beam, said track wheel being engageable with either the first or second bin lid track; and (e) bin lid actuation means associated with each movable bin lid panel;

wherein:

(f) the bin lid tracks define selected paths of travel for the inner longitudinal edge of the movable bin lid panels, such that the bin lid actuation means can be operated to move the movable bin lid panel between:

a closed position in which the outer longitudinal edge of the movable bin lid panel is proximal to the top of one of the sidewalls, with the bin lid panel's track wheels being disposed within their corresponding bin lid tracks at a medial position between the sidewalls; and an open position in which the movable bin lid panel is positioned alongside and external to the associated sidewall, with the movable bin lid panel's track wheels being disposed within their corresponding bin lid tracks at a lateral position proximal to the lateral position of the associated sidewall; and (g) the bin lid actuation means comprises at least one pivot arm pivotably mounted at a first end thereof to the associated bin sidewall, and pivotably mounted at a second end thereof to a pivot bracket attached to the outer longitudinal edge of the movable bin lid panel, such that:

the direct application of force to the movable bin lid panel in a first direction, when the movable bin lid panel is in the closed position, will move the outer longitudinal edge of the movable bin lid panel outward and downward away from the top of the associated bin sidewall, with the movable bin lid panel's track wheels correspondingly moving laterally outward within their corresponding bin lid tracks, thus moving the movable bin lid panel toward the open position; and the direct application of force to the movable bin lid panel in a second direction opposite to the first direction, when the movable bin lid panel is in a position other than the closed position, will move the outer longitudinal edge of the movable bin lid panel inward and upward toward the top of the associated bin sidewall, with the movable bin lid panel's track wheels correspondingly moving laterally inward within their corresponding bin lid tracks, thus moving the movable bin lid panel toward the closed position.

10. An open-top bin comprising:

(a) a floor, a first endwall, a second endwall, and a pair of opposing longitudinal sidewalls, wherein said endwalls and sidewalls extend upward from the floor, and each sidewall extends between the first and second endwalls;

(b) a first track box structure extending vertically above and horizontally between the sidewalls, and extending horizontally from the first endwall to a first inner track box wall, wherein said first inner track box wall carrying a first bin lid track;

(c) a second track box structure extending vertically above and horizontally between the sidewalls, and extending horizontally from the second endwall to a second inner track box wall, so as to define a bin roof opening bounded by the sidewalls and the first and second inner track box walls, and wherein said second inner track box wall carries a second bin lid track corresponding to the first bin lid track;

(d) an arched bin lid configured to cover substantially the full area of the bin roof opening, wherein said arched bin lid has:

two opposing longitudinal side edges;

a longitudinal ridge at a medial position between the longitudinal side edges;

a longitudinal beam extending below and along the length of longitudinal ridge; and a track wheel at each end of the longitudinal beam, said track wheel being engageable with either the first or second bin lid track; and (e) bin lid actuation means;

wherein:

(f) the bin lid tracks define selected paths of travel for the track wheels, such that the bin lid actuation means can be operated to move the arched bin lid between:

a closed position in which each longitudinal side edge of the arched bin lid is proximal to the top of one of the sidewalls, with the track wheels being disposed within their corresponding bin lid tracks at a medial position between the sidewalls; and an open position in which a portion of the arched bin lid is positioned alongside and external to a first one of the sidewalls, with a first one of the longitudinal side edges being disposed above the top of the first one of the sidewalls, with the second one of the longitudinal side edges being disposed above the top of the first one of the sidewalls, and with the arched bin lid's track wheels being disposed within their corresponding bin lid tracks at a lateral position proximal to the lateral position of the first one of the sidewalls; and (g) the bin lid actuation means comprises a horizontally-oriented bin lid actuation shaft mounted to the exterior of the first one of the bin sidewalls, said bin lid actuation shaft being selectively rotatable by a shaft rotation means; and at least one pivot arm rigidly fixed at a first end thereof to the lid actuation shaft, and pivotably mounted at a second end thereof to a pivot bracket attached to the first one of the longitudinal side edges of the arched bin lid corresponding to the first one of the bin sidewalls, such that:

rotation of the bin lid actuation shaft in a first direction, when the arched bin lid is in the closed position, will move the first longitudinal side edge of the arched bin lid outward and downward away from the top of the first one of the bin sidewalls, with the arched bin lid's track wheels correspondingly moving laterally outward within their corresponding bin lid tracks, thus moving the arched bin lid toward the open position; and rotation of the lid actuation shaft in a second direction opposite to the first direction, when the arched bin lid is in a position other than the closed position, will move the first one of the longitudinal side edges of the arched bin lid inward and upward toward the top of the first one of the bin sidewalls, with the arched bin lid's track wheels correspondingly moving laterally inward within their corresponding bin lid tracks, thus moving the arched bin lid toward the closed position.

11. An open-top bin as in claim 10 wherein the shaft rotation means comprises a crank-operated gearbox.

12. An open-top bin as in claim 10, further comprising counterweighting means.

13. An open-top bin as in claim 12 wherein the counterweighting means comprises:

(a) one or more helical springs mounted in association with arched bin lid, with each of said one or more helical springs being anchored at a first end thereof to an anchorage point on the first one of the bin walls;

(b) a cable attached at one end thereof to a second end of each of the one or more helical springs, extending over a pulley mounted proximal to the top of the first one of the bin sidewalls, and attached at a second end thereof to one of the pivot arms at a selected radial distance from the bin lid actuation shaft.

14. An open-top bin comprising:

(a) a floor, a first endwall, a second endwall, and a pair of opposing longitudinal sidewalls, wherein said endwalls and sidewalls extend upward from the floor, and each sidewall extends between the first and second endwalls;

(b) a first track box structure extending vertically above and horizontally between the sidewalls, and extending horizontally from the first endwall to a first inner track box wall, wherein said first inner track box wall carrying a first bin lid track;

(c) a second track box structure extending vertically above and horizontally between the sidewalls, and extending horizontally from the second endwall to a second inner track box wall, so as to define a bin roof opening bounded by the sidewalls and the first and second inner track box walls, and wherein said second inner track box wall carries a second bin lid track corresponding to the first bin lid track;

(d) an arched bin lid configured to cover substantially the full area of the bin roof opening, wherein said arched bin lid has:

two opposing longitudinal side edges;

a longitudinal ridge at a medial position between the longitudinal side edges;

a longitudinal beam extending below and along the length of longitudinal ridge; and a track wheel at each end of the longitudinal beam, said track wheel being engageable with either the first or second bin lid track; and (e) bin lid actuation means;

wherein:

(f) the bin lid tracks define selected paths of travel for the track wheels, such that the bin lid actuation means can be operated to move the arched bin lid between:

a closed position in which each longitudinal side edge of the arched bin lid is proximal to the top of one of the sidewalls, with the track wheels being disposed within their corresponding bin lid tracks at a medial position between the sidewalls; and an open position in which a portion of the arched bin lid is positioned alongside and external to a first one of the sidewalls, with a first one of the longitudinal side edges being disposed above the top of the first one of the sidewalls, with the second one of the longitudinal side edges being disposed above the top of the first one of the sidewalls, and with the arched bin lid's track wheels being disposed within their corresponding bin lid tracks at a lateral position proximal to the lateral position of the first one of the sidewalls; and (g) the bin lid actuation means comprises at least one pivot arm pivotably mounted at a first end thereof to the first one of the bin sidewalls, and pivotably mounted at a second end thereof to a pivot bracket attached to the first one of the longitudinal side edges of the arched bin lid, such that:

the direct application of force to the arched bin lid in a first direction, when the arched bin lid is in the closed position, will move the first longitudinal side edge of the arched bin lid outward and downward away from the top of the first one of the bin sidewalls, with the arched bin lid's track wheels correspondingly moving laterally outward within their corresponding bin lid tracks, thus moving the arched bin lid toward the open position; and the direct application of force to the arched bin lid in a second direction opposite to the first direction, when the arched bin lid is in a position other than the closed position, will move the first one of the longitudinal edges of the arched bin lid inward and upward toward the top of the first one of the bin sidewalls, with the arched bin lid's track wheels correspondingly moving laterally inward within their corresponding bin lid tracks, thus moving the arched bin lid toward the closed position.

* * * * *